US006250001B1

(12) United States Patent
Gillespie

(10) Patent No.: US 6,250,001 B1
(45) Date of Patent: Jun. 26, 2001

(54) ADVERTISING FLOOR MAT

(75) Inventor: Eugene Gillespie, Atlanta, GA (US)

(73) Assignee: Indoor Media Group, Inc., Azle, TX (US)

( * ) Notice: Subject to any disclaimer, the term of this patent is extended or adjusted under 35 U.S.C. 154(b) by 0 days.

(21) Appl. No.: 09/124,591

(22) Filed: Jul. 29, 1998

Related U.S. Application Data

(63) Continuation-in-part of application No. 08/997,301, filed on Dec. 23, 1997.

(51) Int. Cl.[7] ..... G09F 7/04
(52) U.S. Cl. ..... 40/600; 52/DIG. 13
(58) Field of Search ..... 40/600, 773; 428/7, 428/67; 52/DIG. 13

(56) References Cited

U.S. PATENT DOCUMENTS 3,930,084 * 12/1975 Shields ..... 428/67
4,292,352 * 9/1981 Singer ..... 428/7
4,415,620 * 11/1983 Yamazaki et al. ..... 52/DIG. 13
5,167,087 * 12/1992 Plumly ..... 40/600
5,533,288 * 7/1996 Lambert ..... 40/773

FOREIGN PATENT DOCUMENTS

2847590 * 5/1980 (DE) ..... 40/600

* cited by examiner

*Primary Examiner*—Joanne Silbermann
(74) *Attorney, Agent, or Firm*—Arthur F Zobal

(57) ABSTRACT

The floor advertising apparatus is used in a cavity formed in a flexible floor mat. In one embodiment, the floor mat has a base with fibers on its upper side with an area free of the fibers forming the cavity. In another embodiment, a solid portion surrounds the area defining the cavity. The advertising apparatus includes a top transparent layer removably held in the cavity of the floor mat by different types of magnetic arrangements, adhesive, hook and loop fasteners or mechanical fasteners. In use, an advertising medium is located below the transparent layer.

29 Claims, 8 Drawing Sheets

ADVERTISING FLOOR MAT

This application is a continuation-in-part of U.S. patent application Ser. No. 08/997,301, filed on Dec. 23, 1997.

BACKGROUND OF THE INVENTION

1. Field of the Invention

The invention relates to the use of an advertising medium removably coupled to a floor mat.

2. Description of the Prior Art

Standard carpet and rubber type entryway mats are used widely in many types of retail stores and commercial buildings. Their main purpose is to provide a means to wipe shoes on upon entering a building from the outside. In some cases, these mats are embossed with a permanent message/name or logo of the establishment where they are used. The current standard floor mats generally range in a size of 2 ft×3 ft, up to 5 ft by 7 ft. They can be rolled up, moved and located easily to other locations, and can be cleaned using automatic mat cleaning equipment.

Up until now the use of these type of mats has been limited in their ability to convey a message to the public that crosses over or near them. The concept of advertising on the floor and its effectiveness in increasing sales is widely accepted as an enhancement to a retail store. There currently exist in the market place products that can be installed into a floor that will allow promotion of specialize advertising type messages. Most of these products offer the features of being located in specific locations within the store and are easily able to change the advertising message. Again, this type of current advertising type apparatuses are installed into the existing floor and become a apart of the floor surface. Although these products work well in some applications, they do require removal of the existing floor pieces. In some retail stores and floor type, this type of in the floor installation creates added expense and concern to the owner of the store. A ceramic (quarry) type floor construction is one type of floor material that creates problems to a permanent installation features.

U.S. Pat. Nos. 5,167,087; 5,303,493; 5,353,535; 5,363,579; and 5,524,373 disclose prior art floor type advertising apparatuses.

SUMMARY OF THE INVENTION

It is an object of the invention to provide a unique advertising apparatus comprising an advertising medium removably coupled to a floor mat.

The floor mat comprises a base with an upper side. The upper side comprises a portion which surrounds an area free from fibers defining a cavity. A thin lower holding layer is coupled to the fiber free area in the cavity. A thin upper holding layer is located in the cavity with a thin transparent layer coupled to the upper side of the upper holding layer. The transparent layer and the upper holding layer are movable relative to the lower holding layer for displaying different advertisements below the transparent layer for viewing from above the apparatus. The advertising material may comprise a separate removable layer or an advertisement layer coupled to the underside of the transparent layer.

The floor mat may comprises surrounding fibers defining the cavity or a solid surrounding portion defining the cavity.

The two holding layers may comprise magnetic material respectively, magnetic material and iron respectively, or hook and loop fasteners respectively such that the two holding layers are removably held together.

In other embodiments, adhesive material or other type of fasteners are employed for removably coupling said transparent layer to the base of the mat in the cavity.

DESCRIPTION OF THE PREFERRED EMBODIMENTS

Figure 1:
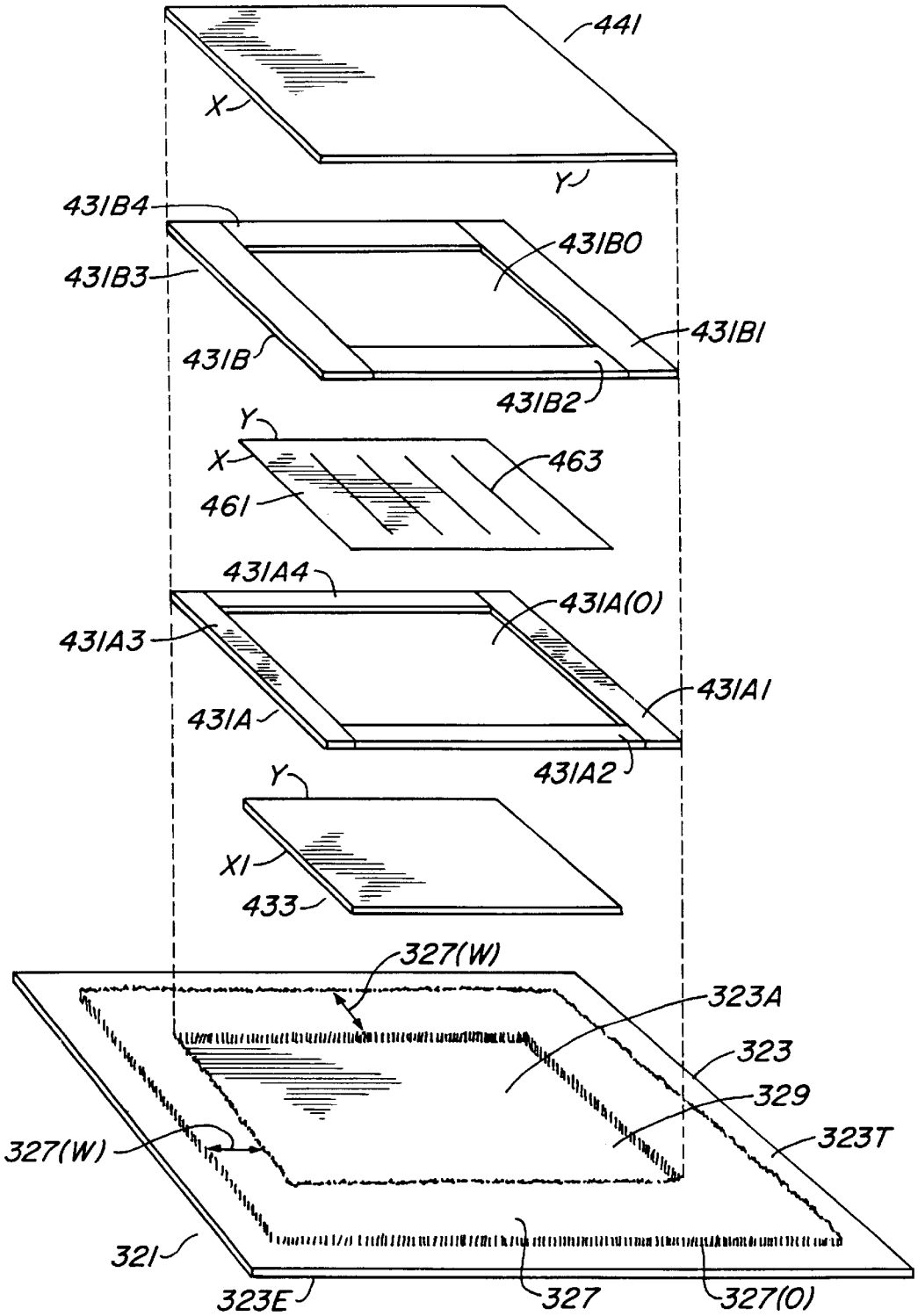
FIG. 1 is an exploded view of one embodiment of the apparatus of the invention.
Figure 2:
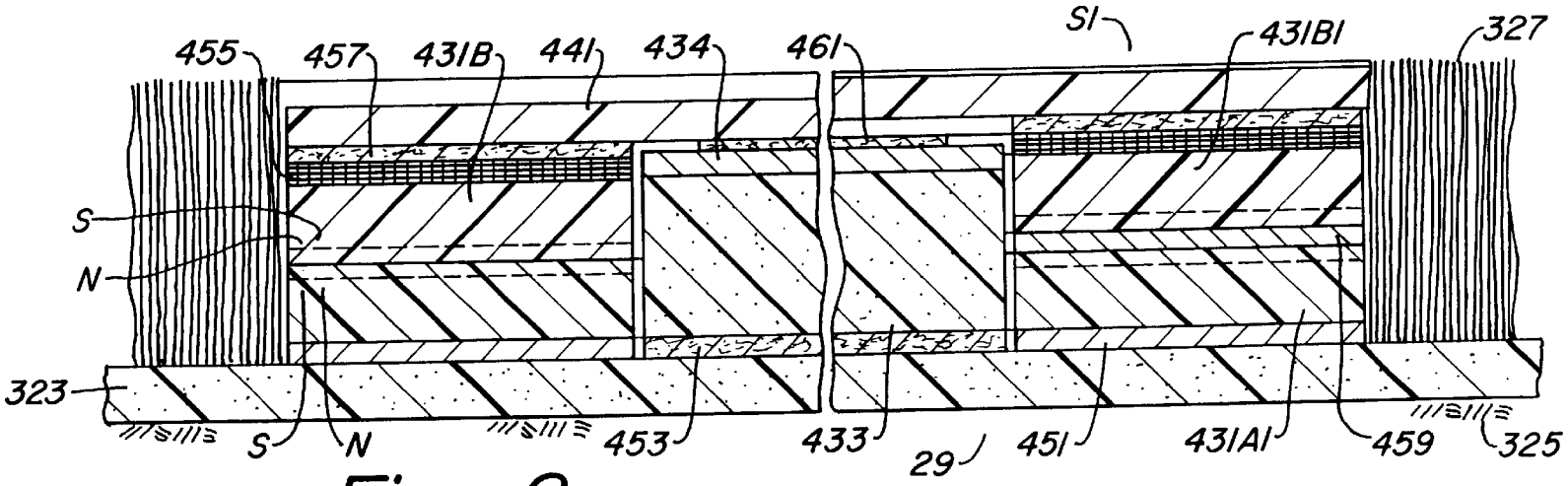
FIG. 2 is a cross sectional view of the apparatus of FIG. 1.
Figure 3:
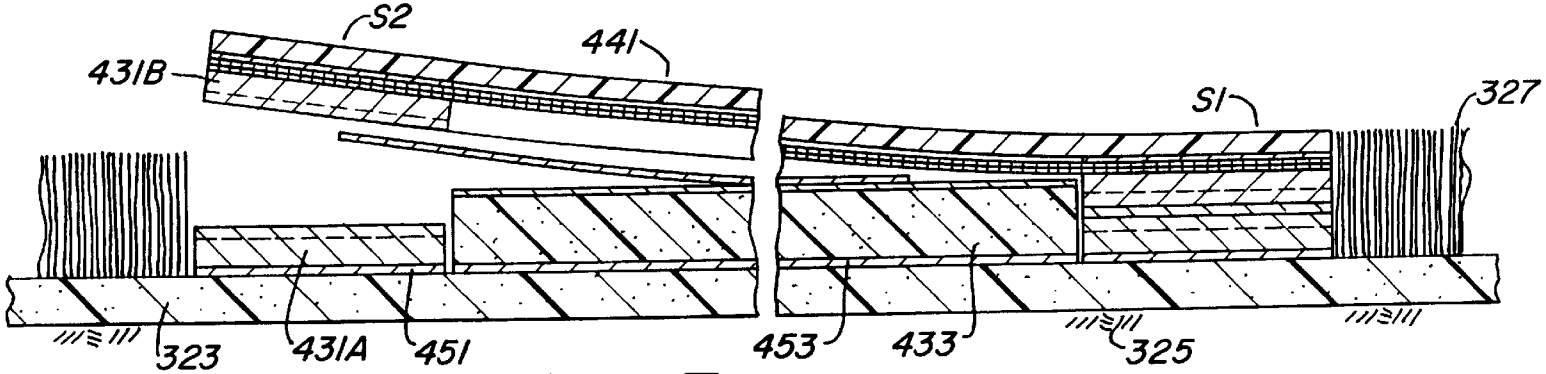
FIG. 3 is a cross sectional similar to that of FIG. 2 with the upper holding and transparent layers partially open.

Referring now to FIGS. 1–3, there is disclosed a floor mat 321 having a base 323 adapted to be supported by the floor 325 of a building, etc. The base 323 may be formed of a suitable elastomer such that it is flexible. Secured to the top 323T of the base are fibers 327 which may be formed of a suitable plastic or natural material. The fibers 327 have their outer edges 327(O) spaced inward from the edges 323E of the base although the fibers 325 could extend to the edges 323E of the base. The upper interior area 323A of the base 323 is free of fibers such that the fibers 327 surround the area 323A free from fibers defining a cavity 329. The width 327(W) of the fiber portion may be much greater than that shown.

An advertising apparatus comprising members 431A, 431B, 433, 441, and 461 are adapted to fit in the cavity 329. The member 431A is a lower holding layer of flexible magnetic material having a central opening 431AO. The member 441 is a flexible transparent layer in sheet form of flexible plastic material. The member 431B is an upper holding layer of flexible magnetic material having a central opening 431BO. The member 433 is a flexible layer of plastic material in sheet form cut to fit in the opening 431BO of layer 431B. The layer 433 may have a layer of opaque material 434 secured to its top side. Member 461 is an advertising layer having advertising material 463 on its top side.

The layer 43 1A is secured in the cavity 329 to the base area 323A with adhesive tape 451 and the layer 433 is located in the opening 431A(O) of layer 431A and secured in the cavity 329 to the base area 323A with adhesive tape 453. The tape 451 and 453 each is of the type that has adhesive on both sides. The dimensions of the layer 433 are such that the layer 433 will fit in the opening of layer 431A with a close fit between the edges of the layer 433 and the inner edges of the layer 431A. The outside dimensions of the layers 441, 431A and 431B are substantially the same. The top side of layer 431B is secured to the bottom side of layer 441 with opaque tape 455 having adhesive on its bottom side and transparent adhesive 457 on its top side. The color of tapes 434 and 455 may be the same. The bottom of one side edge 431B1 of the layer 431B at side S1 is bonded to the top of one side edge 431A1 of layer 431A with double sided adhesive tape 459 such that the other side S2 of layers 431B and 441 can be folded back towards the side S1 as shown in FIG. 3 to allow an advertising layer 461 to be removed from the cavity or located on the top surface of layer 433. Tape 459 has adhesive on both sides. In FIG. 3, the advertising layer 461 is shown partially on the layer 433. In FIG. 2, the advertising layer 461 is shown located on the layer 433 and the layers 441 and 431B are in their closed positions with layer 431A adjacent and engaging layer 431B such that the magnetic materials in layers 431A and 431B hold the two layers together and form a seal to prevent water from reaching the advertising layer 461 which may be of paper having advertising 463 on its top side. The layer 433 has a height such that its top side is located close to the top side of layer 431B when in its closed position to prevent creasing or bending of the transparent layer 441 at the inner edge of magnetic layer 431B when a person steps on the transparent layer 441.

The layers 441 and 431B may be lifted at side S2 to remove or place an advertising layer 461 from or on the layer 433.

Layers 431B and 431A may be formed of a flexible plastic in sheet or strip form having magnetic particles embedded therein.

Layers 431B and 431A each comprise plastic material with magnet particles embedded therein in alternate rows N and S such that the N rows produce a "North" magnetic force and the S rows produce a "South" magnetic force. The layer 431B preferably is formed of four strips 431B1, 431B2, 431B3 and 431B4 secured together against the bottom of layer 441 such that the rows N and S extend parallel to the length of the strips. The layer 431A preferably is formed of four strips 431A1, 431A2, 431A3, and 431A4 secured to the mat base 329 such that the rows N and S extend parallel to the length of the strips. Strips 431B2 and 431A2 are formed and located such that the N rows of strip 431B2 are located next to the S rows of strip 431A2 when the layer 431B is in its closed position such that maximum magnetic attractive force is achieved. Similarly, strips 431B3 and 431A3 are formed and located such that the N rows of strip 431B3 are located next to the S rows of strip 431A3 when the layer 431B is in its closed position; strips 431B4 and 431A4 are formed and located such that the N rows of strip 431B4 are located next to the S rows of strip 431A4 when the layer 431B is in its closed position, and strips 431B1 and 431A1 are formed and located such that the N rows of strip 431B1 are located next to the S rows of strip 431A1. The strips of layers 431B and 431A each have a strong side with strong magnetic lines of force and a weak side with weaker magnetic lines of force. The strips will be secured and located such that the strong sides of the strips of layer 431B will face the strong sides of the strips of layer 431A. Reference is made to U.S. Pat. No. 5,524,373 for a more detailed description of the magnetic layers 431B and 431A.

The advertising layer 461 will have dimensions X and Y which are slightly less than the dimensions X1 and Y1 of the layer 433.

The tape 459 has an adhesive with more holding or sticking power on one side than the other and hence has a high holding side and a low holding side. This type of tape is known as a high/low tape. The high holding side will be secured to the bottom of side 431B1 of layer 431B to allow the layer 431B with the tape to be readily removed for replacement purposes.

The tape 459 may be eliminated to allow layers 431B and 441 to be readily removed completely from layer 431A to allow an advertisement layer 461 to be removed from or placed on the layer 433.

In the embodiments of FIGS. 1–3, adhesive may be used to secure the layers 431A and 433 to the base 323 and to secure the layers 441 and 431B together in lieu of adhesive tape.

Figure 4:
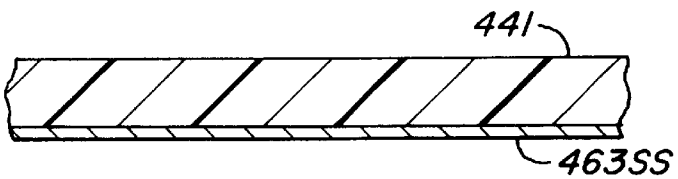
FIG. 4 is a cross section of a modification of the embodiment of FIGS. 1–3.

Referring to FIG. 4, instead of using a separate advertising layer 461, the advertising material 463SS may be coupled to the bottom side of the transparent layer 431 for example by a silk-screening process as disclosed in U.S. Pat. No. 5,524,373 which is hereby incorporated herein by reference. In this embodiment, the transparent layer 441 and the coupled advertising layer 466SS are removed from the cavity as a unit and a layer 441 with a new layer 463SS replaced when desired.

In another embodiment, the layer 431B may be formed of magnetic material as described above and the layer 431A may be formed of a material that includes iron such a thin flexible sheet of galvanized metal such that the magnetic lines of force produced by layer 431B removably holds the layer 431B to layer 431A. In this embodiment, the layer 431A will have the same shape and secured to the base 323 as described previously.

In still another embodiment, the layer 431A may be formed of magnetic material secured to the base 323A as described previously and the layer 431B formed of a flexible material that includes iron such as a thin flexible sheet of galvanized metal such that the magnetic lines of force produced by layer 431A removably holds the layer 431B to layer 431A. In this embodiment, the layer 431B will have the same shape and secured to the layer 441 as described previously. Its side 431B1 may be secured to side 431Al of layer 431A as described previously.

Figure 5:
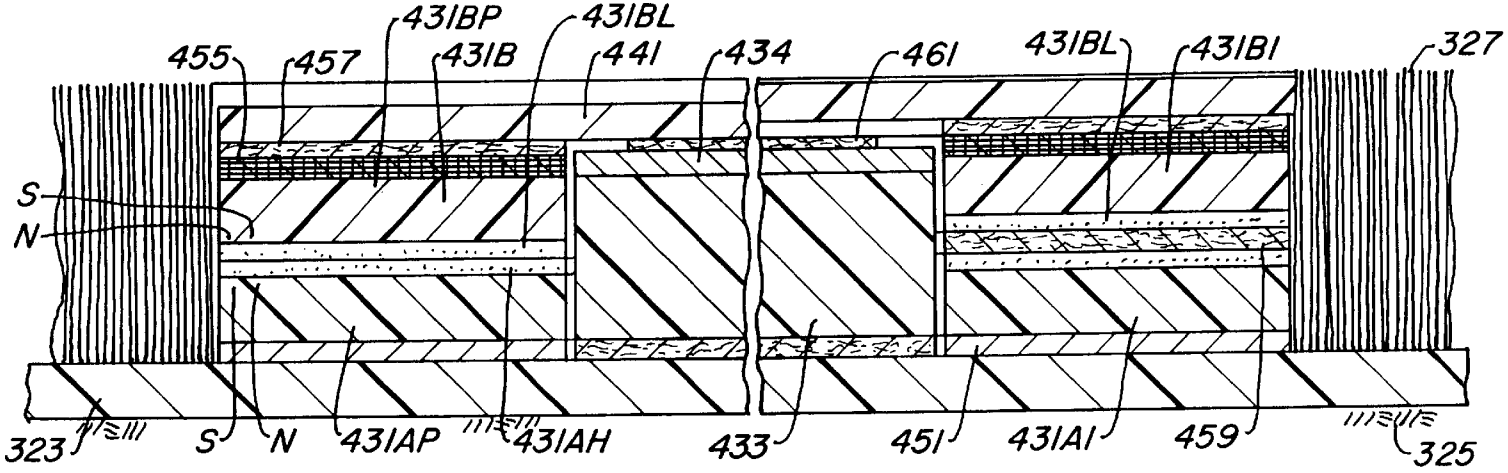
FIG. 5 is a cross sectional view of another embodiment of the apparatus of the invention.
Figure 6:
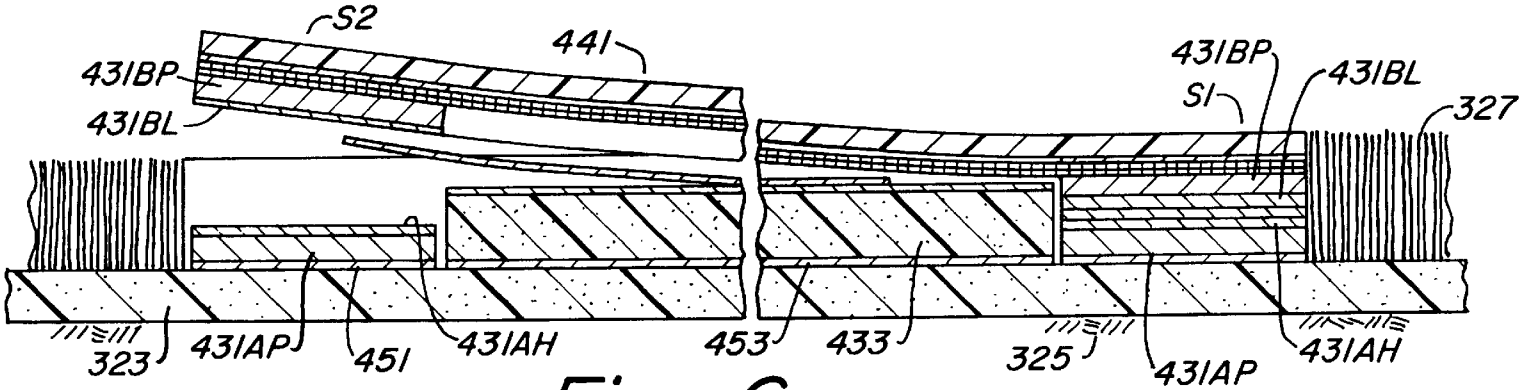
FIG. 6 is a cross sectional view of the embodiment of FIG. 5 with the upper holding layer and transparent layer partially open.

In a further embodiment, the layers 431B and 431A are modified as shown in FIG. 5 such that they employ hook and loop fasteners (VELCRO) on their bottom and top sides respectively or loop and hook fasteners on their bottom and top sides respectively. Referring to FIG. 5, layer 431B comprises a thin flexible plastic layer 431BP and a loop fastener layer 431BL secured to the bottom side of layer 431BP with adhesive. The layer 431A comprises a plastic layer 431AP and a hook fastener layer 431AH secured to the top side of layer 431AP with adhesive. Layers 431BP/431BL and 431AP/431AH have the same shape as layers 431B and 431A respectively as described previously. The top side of layer 431BP is secured to the bottom side of layer 441 with tape 455 and adhesive 457 as described previously. The bottom side of layer 431AP is secured to the base 323 with tape 451. The rear bottom and top sides of layers 431BL and 431AH are secured together with the tape 459. The hook and loop fasteners and the arrangement described enable the layers 431BP/431BL and 431AP/431AH to be removably secured together for allowing one to change the advertising layer 461 or to remove the layer 431BP/431BL.

Instead of using the separate advertising layer 461 the advertising can be silk screened to the bottom side of transparent layer 441 as described in connection with FIG.

4 and the transparent layer 441 and the silk screened layer 463SS removed as a unit and a layer 441 with a new layer 463SS replaced when desired.

Figure 8:
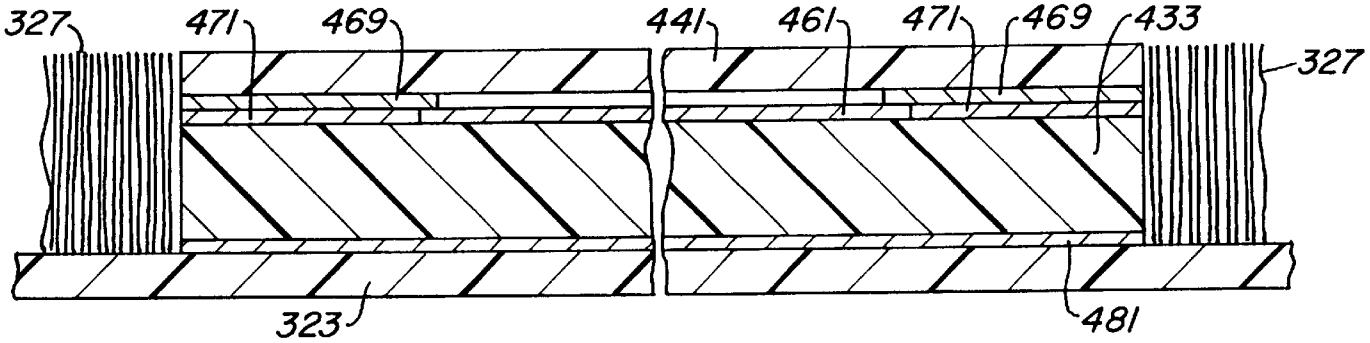
FIG. 8 is a cross sectional view of the apparatus of FIG. 7.
Figure 9:
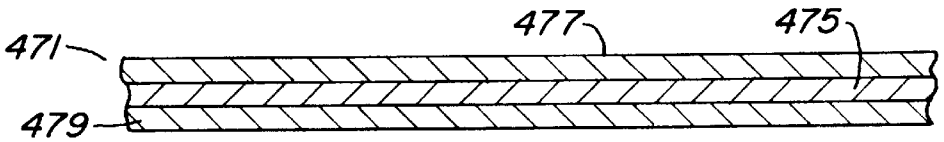
FIG. 9 is a partial cross sectional view of adhesive tape used in the apparatus of FIGS. 7 and 8.
Figure 7:
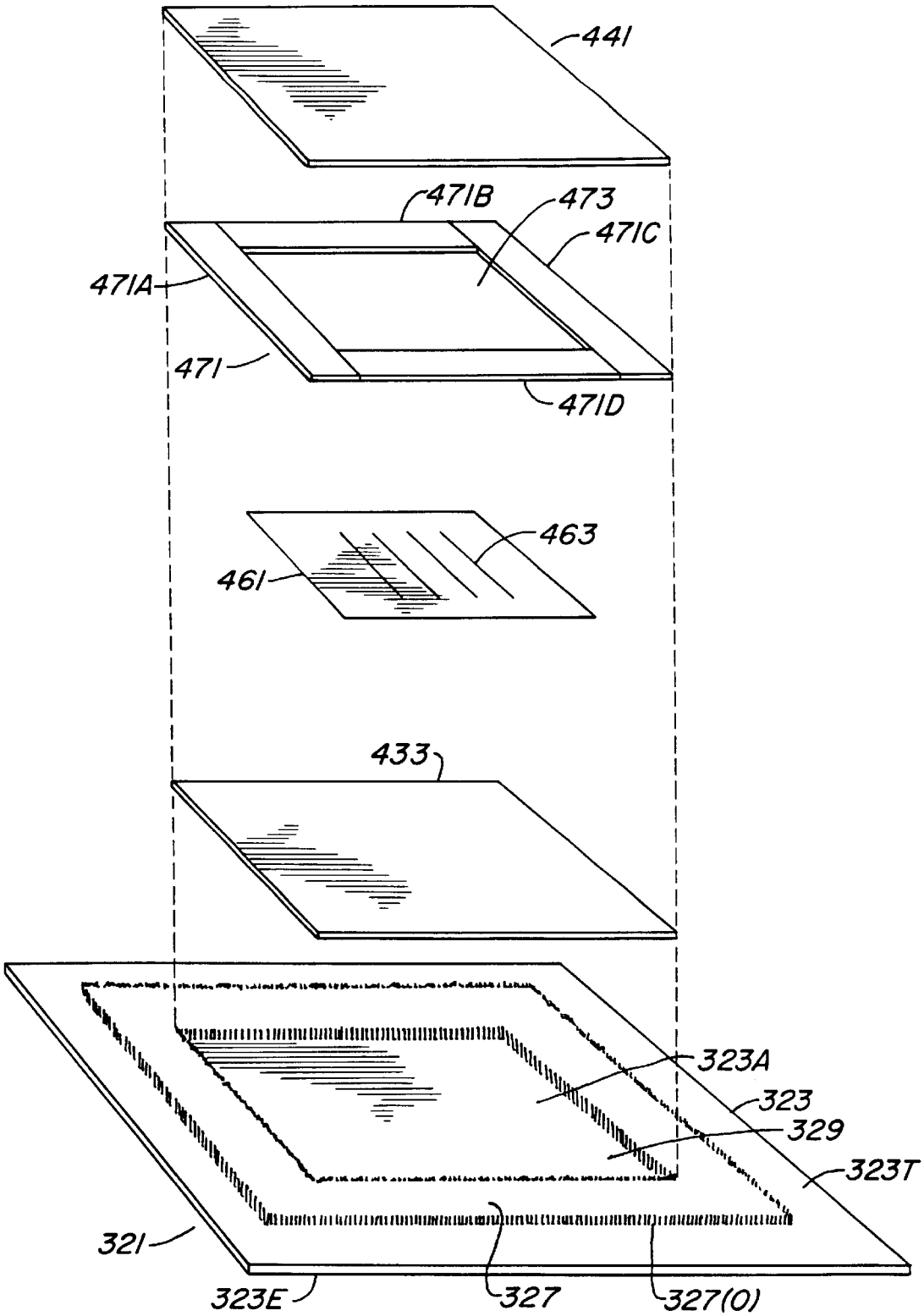
FIG. 7 is an exploded view of another embodiment of the apparatus of the invention.

Referring now to FIGS. 7–9, there will be described an embodiment wherein the transparent layer 441 is removably held in place by adhesive. In FIGS. 7–9 like reference numerals identify the same components as disclosed in connection with FIGS. 1–6. The apparatus of FIGS. 7–9 includes a transparent layer 441 of flexible plastic material, an advertising layer 461 with advertisement 463 on its top side and a support layer 433 to be located in the cavity 329. A border 469 is formed on the bottom side of layer 441 by a silk-screen process. Also provided is a layer 471 formed of double sided adhesive tape also known as differential tape or high/low. The layer 471 may be formed of four strips 471A, 471B, 471C, and 471D of differential tape secured to the bottom side of layer 441 in the configuration shown to have an opening 473 extending therethrough.

A cross section of the differential tape is shown in FIG. 9. It comprises a flexible base 475 having layers of adhesive 477 and 479 on opposite sides. The adhesive layer 477 has a greater sticking or adhering power than the other adhesive layer 479. The tape strips 471A–471D are secured to the bottom side of the transparent layer 441 with the greater sticking power adhesive layer 477 contacting and engaging the bottom side of layer 441.

The layer 433 is secured to the base 323A in the cavity 329 with adhesive or double sided tape 481. The advertising layer 461 with its advertising layer 463 facing upward will be located on the support layer 433 and the transparent layer 441 with the tape layer 471 secured thereto then will be secured to the top of the layer 433 by contacting the lesser sticking power adhesive layer 479 with the layer 433. The advertising layer 461 will be located in the opening 473 of the tape layer 471.

When it is desired to change the advertising layer 461, the layers 441 and 471 are lifted from the layer 433 to allow the advertising layer 461 to be removed and replaced at which time the layer 441 will be secured to the layer 433 with the adhesive layer 471 over the new advertising layer 461. With the high sticking layer 477 applied to the transparent layer 441, the layer 441 and tape 471 can be secured to and removed from the layer 433 a number of times before the sticking power of the layer 479 diminishes to a point that it cannot effectively hold the layer 441 to the layer 433.

As an alternative the advertising medium 461 may not be used and advertisement secured to the underside of the transparent layer 441 for example by silk-screening as disclosed in FIG. 4 and in U.S. Pat. No. 5,524,373. A new layer 441 with a silk-screen ad will be used when it is desired to change the advertisement.

Figure 10:
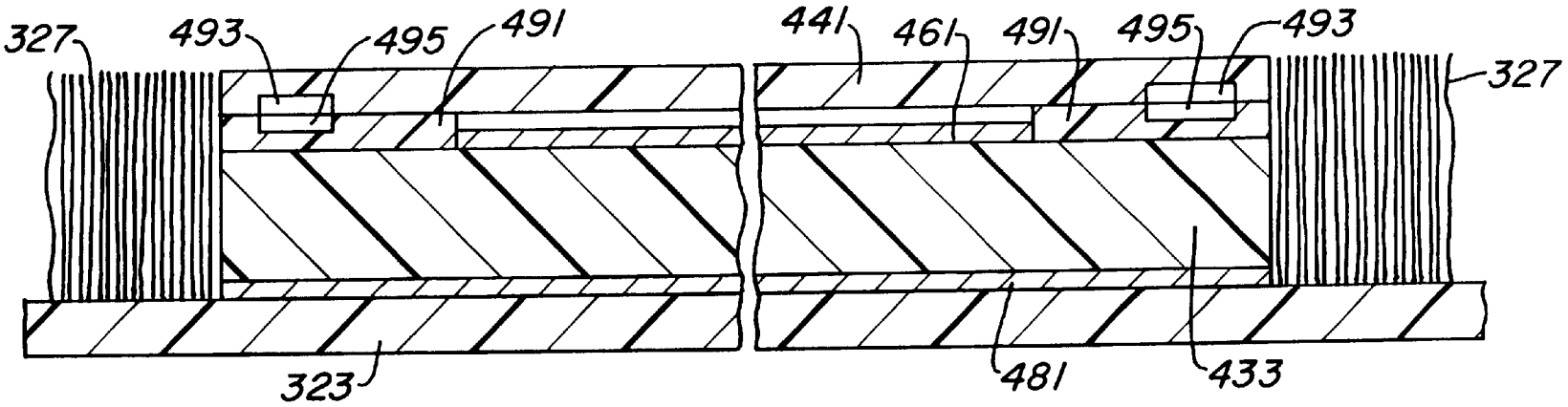
FIG. 10 is a cross sectional view of another embodiment of the apparatus of the invention.

Referring to FIG. 10, there will be described an embodiment wherein the transparent layer 441 is removably held in place by a mechanical connection arrangement. In FIG. 10, like reference numerals identify the same components as disclosed in FIG. 8. The apparatus of FIG. 10 includes a transparent layer 441 of flexible plastic material, a removable advertising layer 461 with advertisement 463 on one side, a support layer 433 located in the mat cavity by the double sided tape 481 and a spacer layer 491 of plastic material secured to the layer 433 by adhesive. The spacer layer 491 has a rectangular opening such that the layer 491 surrounds the advertising layer 461 when located in place.

Coupled to the bottom side of the transparent member 441 and to the top side of layer 491 are two snap members 493 and 495 which may be male or female members respectively or vice versa.

When it is desired to change the advertising layer 461, the snap members 491 and 493 are uncoupled and the layer 461 lifted to allow the old advertising layer 461 to be removed and a new advertising layer 461 inserted on the layer 433. The layer 441 then is located and held in place by coupling the snap members 493 and 495 together.

As an alternative, the advertising medium 461 may not be used and advertising secured to the underside of the layer 441 for example by silk screening as disclosed in FIG. 4.

The snap members 493 and 495 may be formed of metal or plastic.

In one embodiment, the plastic layers 441 and 433 may be formed of a flexible plastic material such as polycarbonate or VIVAK.

In the embodiments of FIGS. 1–10, the floor mat 321 may have dimensions of 1×2 feet up to 5×7 feet or other dimensions with a total height of about 3/16 of an inch. The base 323 may have a thickness of about 1/8 of an inch and the fibers 327 from the base 323 may have a height of about 2/16 of an inch. It is to be understood that these dimensions may vary. The cavity 329 may have different width and length dimensions within the width and length dimensions of member 321. The width and length dimensions of members 441, 431B and 431A are such that they will fit snugly within the cavity 329. The base 323 may be a neoprene type rubber or elastomer base and the fibers 327 may be formed of nylon or other materials molded to the base when in a hot state such that the mat 321 is flexible. The fibers may be looped at their upper ends. The support member 433 may be formed of a suitable flexible plastic material, the components of the apparatus that fit in the cavity 329 will have thickness such that the top of layer 441 is about flush with the top of the fibers 327 when the apparatus is located in the cavity.

The mat 321 may be used in many places in a retail business on top of an existing floor without the need of disrupting existing floor surface. By removing the advertising apparatus from the mat the mat can be rolled, handled, moved and cleaned as a standard mat.

It is to be understood that the mat and the advertising apparatus may have dimensions different from those mentioned above.

In the embodiments which employ a separate advertising layer 461, if the layer 461 is relatively thick, the support member 433 may not be needed whereas the layer 461 will rest directly on the area 323A.

Figure 11:
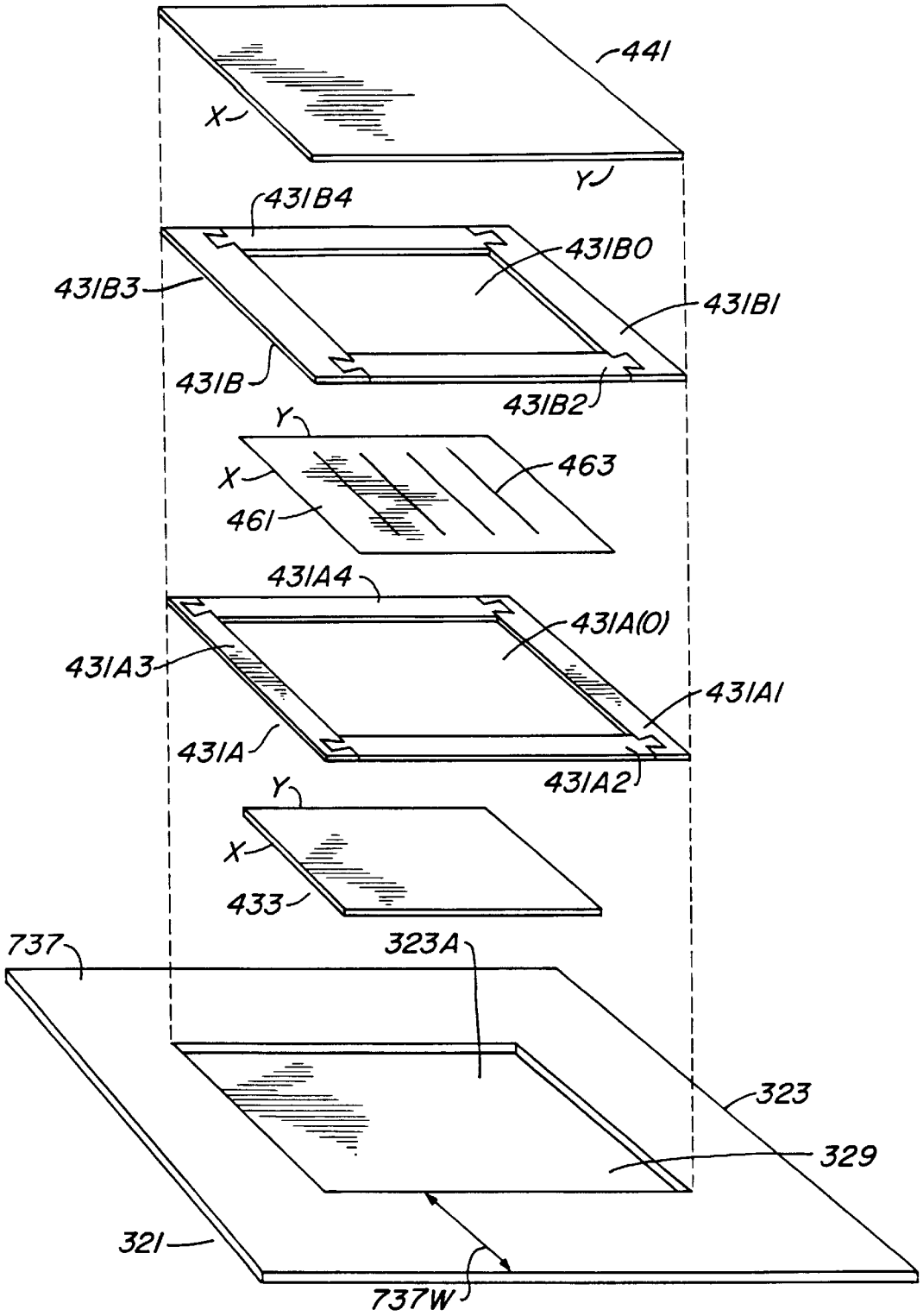
FIG. 11 is an exploded view of another embodiment of the apparatus of the invention.
Figure 12:
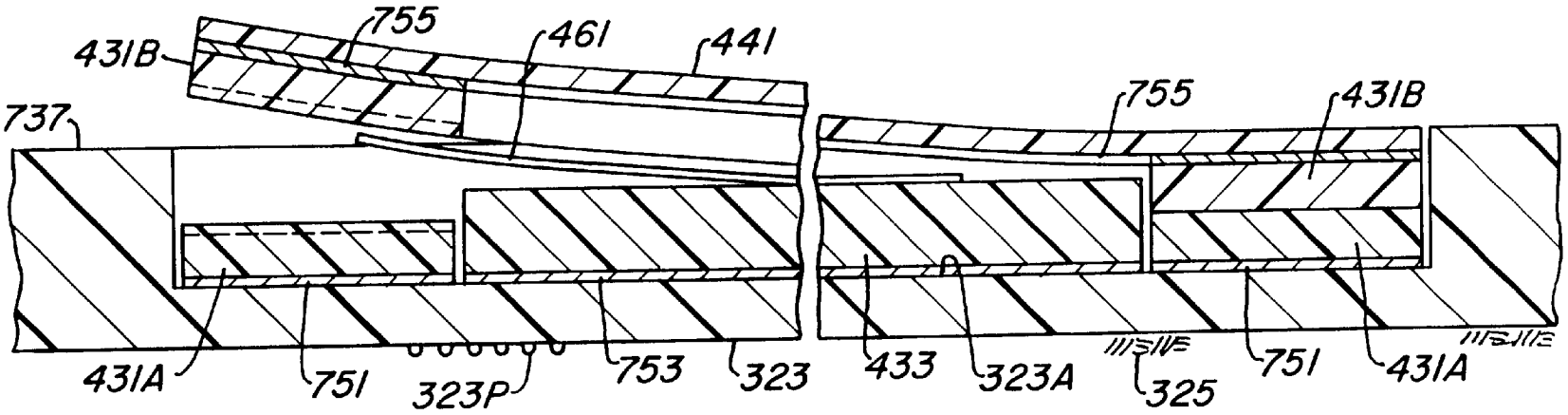
FIG. 12 is a cross-sectional view of the apparatus of FIG. 11 with the upper holding layer partially open.

In the embodiment of FIGS. 1–10, the surrounding portion defining the cavity 329 comprises fibers 327. Referring to FIGS. 11 and 12, the floor mat 321 is similar to that of FIGS. 1–3 except that the base 323 has a surrounding portion 737 formed of solid material which surrounds the base area 323A and forms the cavity 329. The base 323 including the surrounding solid portion 737 and the base area 323A may be molded as a single unit from a suitable elastomer such that the base 323 including the side wall portion 733 and the interior area 323A or lower floor are flexible. The advertising apparatus in one embodiment, comprises the members 431A, 431B, 433, 441, and 461 adapted to fit in the cavity 327. These members in one embodiment, may be the same as members 431A, 431B, 433, 441, and 461 as disclosed in FIGS. 1–3 and assembled in the same manner as described in the embodiment of FIGS. 1—3.

In an alternative, in the embodiment of FIGS. 11 and 12, members 431A, 441, and 461 are the same as those described in connection with FIGS. 1—3 and members 431B, 433 are solid opaque members. The assembly of members 431A, 431B, 433, 441 and 461 is as follows. The layer 431A is secured or attached in the cavity 329 to the base area 323A with adhesive 751 and the layer 433 is located in the opening 431A(O) of layer 431A and secured or attached in the cavity 329 to the base area 323 with adhesive 753. The dimensions of the layer 433 are such that the layer 433 will fit in the opening of layer 431A with a close fit between the edges of the layer 433 and the inner edges of the layer 431A. The outside dimensions of the layers 441, 431A, and 431B are substantially the same. The top side of layer 431B is secured or attached to the bottom side of layer 441 with adhesive 755. In FIG. 12, the advertising layer 461 is shown partially on the layer 433. The layer 433 has a height such that its top side is located close to the top side of layer 431B when in its closed position to prevent creasing or bending of the transparent layer 441 at the inner edge of magnetic layer 431B when a person steps on the transparent layer 441.

The layers 441 and 431B may be lifted from the cavity 329 to remove or insert an advertising layer 461 from or on to the layer 433.

Layers 431B and 431A may be formed of a flexible plastic in strip form having magnetic particles embedded therein as described in connection with FIGS. 1–3 to removably hold member 431B to member 431A when member 431B is in the cavity 323. The height of the surrounding side wall 737 will be about equal to the height of member 441 when it is in the closed position in the cavity with member 431B engaging member 431A. The bottom of the base 323 may have a plurality of spaced apart protrusions 323P to help hold it in place against the floor 325 as shown in FIG. 12. As shown, the members 431A, 431A2, 431A3, and 431A4 may be initially held together by tongue and groove arrangements to form member 431 prior to attachment to the base area 323A. Similarly members 431B1, 431B2, 431B3, and 431B4 may be initially held together by tongue and groove arrangements to form member 431B prior to attachment to member 441.

The floor mat 321 of the embodiment of FIGS. 11 and 12 with the solid surrounding wall 737 may be used in lieu of the mat 321 with the fiber portion 321 in either of the embodiments of FIG. 4; in the embodiment of FIG. 5; in the embodiment of FIGS. 7–9; and in the embodiment of FIG. 10.

In one embodiment, the floor mat 321 of FIGS. 11 and 12 may have total height of about 2/16–3/16 of an inch with the base area 323A having a height of about 1/16 of an inch and the wall portion 737 having a total height of about 2/16–3/16 on an inch. The floor mat 321 of FIGS. 11 and 12 may have dimensions of 1×2 feet up to 5×7 feet or other dimensions. The width 737W may vary.

What is claimed is:

1. An advertising apparatus, comprising:

a floor mat having a flexible base and an upper side, said upper side comprising a portion which surrounds an area of said mat defining a cavity such that said floor mat including said base and said portion is flexible and said floor mat may be supported by a floor and removed therefrom, a thin lower holding layer located in and coupled to said area of said cavity, a thin upper holding layer located in said cavity, said upper holding layer having an upper side and a lower side, a transparent layer of material having an upper side and a lower side, said transparent layer of material being coupled to said upper side of said upper holding layer, said transparent layer of material and said upper holding layer being located in said cavity with the lower side of said upper holding layer located adjacent to the upper side of said lower holding layer and the upper side of said transparent layer of material facing upward, an advertising layer located below said transparent layer of material in a manner to allow said advertising layer to be seen through said transparent layer of material when viewed from above, said transparent layer of material and said upper holding layer being movable relative to said lower holding layer, said flexible base has a lower side, and flexible means coupled to said lower side of said flexible base to help hold said flexible base in place against the floor when supported by the floor.

2. The advertising apparatus of claim 1, wherein:

one of said holding layers comprising magnetic material forming magnetic lines of force and the other of said holding layers being formed of a material which is attracted by the magnetic lines of force from said magnetic material for removably securing said upper holding layer and said transparent layer to said lower holding layer.

3. The advertising apparatus of claim 2, wherein:

said lower holding layer is formed of said magnetic material and said upper holding layer is formed of a material which is attracted by the magnetic lines of force from said magnetic material.

4. The advertising apparatus of claim 3, wherein:

said upper holding layer is formed of a metal which is attracted by magnetic lines of force.

5. The advertising apparatus of claim 2, wherein:

said upper holding layer is formed of said magnetic material and said lower holding layer is formed of said material which is attracted by the magnetic lines of force from said magnetic material.

6. The advertising apparatus of claim 5, wherein:

said lower holding layer is formed of a metal which is attracted by magnetic lines of force.

7. The advertising apparatus of claim 2, wherein:

said floor mat is formed of an elastomer.

8. The advertising apparatus of claim 1, wherein:

said upper and lower holding layers each comprises magnetic material forming magnetic lines of force for removably holding said upper and lower layers together when said upper and lower layers are located next to each other.

9. The apparatus of claim 1, wherein:

said portion of said upper side is solid.

10. The advertising apparatus of claim 1, wherein:

said advertising layer is free from magnetic material.

11. The advertising apparatus of claim 1, wherein:

said advertising layer is separate from said transparent layer and is held below said transparent layer by said transparent layer.

12. The advertising apparatus of claim 1, wherein:

said advertising layer is secured to said lower side of said transparent layer.

13. The advertising apparatus of claim 1, wherein:

said floor mat is formed of an elastomer.

14. An advertising apparatus, comprising:

a floor mat having a flexible base with an upper side, said upper side comprising a portion which surrounds an area of said mat defining a cavity such that said floor mat including said base and said portion is flexible and said mat may be supported by a floor and removed therefrom, a thin transparent layer of material located in said cavity, an advertising layer located below said transparent layer of material in a manner to allow said advertising layer to be seen through said transparent layer of material when viewed from above, coupling means for removably coupling said transparent layer to said base of said mat in said cavity, said flexible base has a lower side, and flexible means coupled to said lower side of said flexible base to help hold said flexible base in place against the floor when supported by the floor.

15. The advertising apparatus of claim 14, wherein said coupling means comprises:

a thin lower holding layer located in and coupled to said base in said cavity, a thin upper holding layer coupled to the lower side of said transparent layer.

16. The advertising apparatus of claim 5, wherein:

one of said holding layers comprising magnetic material forming magnetic lines of force and the other of said holding layers being formed of a material which is attracted by the magnetic lines of force from said magnetic material for removably securing said upper holding layer and said transparent layer to said lower holding layer.

17. The advertising apparatus of claim 16, wherein:

said lower holding layer is formed of magnetic material and said upper holding layer is formed of a material which is attracted by the magnetic lines of force from said magnetic material.

18. The advertising apparatus of claim 17, wherein:

said upper holding layer is formed of a metal which is attracted by magnetic lines of force.

19. The advertising apparatus of claim 16, wherein:

said upper holding layer is formed of magnetic material and said lower holding layer is formed of a material which is attracted by the magnetic lines of force from said magnetic material.

20. The advertising apparatus of claim 19, wherein:

said lower holding layer is formed of a metal which is attracted by magnetic lines of force.

21. The advertising apparatus of claim 16, wherein:

said floor mat is formed of an elastomer.

22. The advertising apparatus of claim 15, wherein:

said upper and lower holding layers each comprises magnetic material forming magnetic lines of force for removably holding said upper and lower layers together when said upper and lower layers are located next to each other.

23. The advertising apparatus of claim 14, wherein said coupling means comprises:

mechanical means for removably coupling said transparent layer of material to said base in said cavity.

24. The apparatus of claim 14, wherein:

said portion of said upper side is solid.

25. The advertising apparatus of claim 14, wherein:

said advertising layer is free from magnetic material.

26. The advertising apparatus of claim 14, wherein said coupling means comprises:

non-magnetic means for removably coupling said transparent layer of material to said base of said cavity.

27. The advertising apparatus of claim 14, wherein:

said advertising layer is separate from said transparent layer and is held in said cavity by said transparent layer.

28. The advertising apparatus of claim 14, wherein:

said transparent layer has a lower side, said advertising layer is secured to said lower side of said transparent layer.

29. The advertising apparatus of claim 14, wherein:

said floor mat is formed of an elastomer.

* * * * *